US006127932A

United States Patent [19]

Wilson et al.

[11] Patent Number: 6,127,932

[45] Date of Patent: Oct. 3, 2000

[54] OPTICAL FLAME SENSOR HAVING OPAQUE HOLLOW TUBE

[75] Inventors: Larry E. Wilson, Marion; Gary D. Wedlake, Huntington, both of Ind.

[73] Assignee: Carrier Corporation, Syracuse, N.Y.

[21] Appl. No.: 09/220,809

[22] Filed: Dec. 23, 1998

[51] Int. Cl.[7] ..... G08B 17/12

[52] U.S. Cl. ..... 340/578; 340/577; 340/228.2; 340/507; 340/511; 340/508

[58] Field of Search ..... 340/577, 578, 340/228.2; 250/554; 431/78, 79

[56] References Cited

U.S. PATENT DOCUMENTS

| | | | |
|---|---|---|---|
| 3,813,551 | 5/1974 | Broadbent et al. | 250/338 |
| 4,322,723 | 3/1982 | Chase | 340/578 |
| 4,750,142 | 6/1988 | Akiba et al. | 364/550 |
| 4,855,718 | 8/1989 | Cholin et al. | 340/578 |
| 5,077,550 | 12/1991 | Cormier | 340/578 |
| 5,245,196 | 9/1993 | Cabalfin | 250/554 |
| 5,448,676 | 9/1995 | White et al. | 385/88 |

*Primary Examiner*—Jeffery A. Hofsass
*Assistant Examiner*—Hung Nguyen

[57] ABSTRACT

A flame sensor for sensing flame produced by the burner of a furnace. The sensor includes a closed end tube having a photosensitive element located therein. The photosensitive element is sealed off from any external light so as to only respond to infrared wavelengths of light emitted from the end of the tube when subjected to a flame produced by the burner of the furnace.

11 Claims, 1 Drawing Sheet

OPTICAL FLAME SENSOR HAVING OPAQUE HOLLOW TUBE

BACKGROUND OF THE INVENTION

This invention relates to the sensing of the presence of a flame produced by a burner within a furnace and in particular to the optical sensing of such a burner flame.

Photo optical sensors have heretofore been used to sense the presence of a flame produced by a burner of a furnace. These photo optical sensors are positioned relative to the burner so as to respond to the light emitted by the flame produced by the burner. It is to be appreciated that such sensing normally occurs under a variety of background lighting conditions. These background conditions may introduce a significant level of noise into any electrical signal generated by the photo sensor. This background noise must be dealt with by the circuitry associated with the photo sensor so as to produce a signal that can be relied upon to indicate the presence of a flame.

SUMMARY OF THE INVENTION

The present invention provides a sensor which eliminates the impact of background lighting when optically sensing the presence of a flame. The sensor includes a hollow tube that is preferably closed at each end. One closed end is preferably formed during fabrication of the hollow tube from a substantially low thermally conductive material. An electrically conductive photo sensitive element is preferably located at one end of the tube and is oriented towards the opposing end of the tube. The closed end tube creates a substantially dark environment for the photo sensitive element.

The sensor is mounted relative to the burner in a furnace so as to position the opposing end of the tube in the red hot portion of the flame produced by the burner. Heat produced by the red hot portion of the flame will cause this end of the tube to rapidly heat up so as to produce infrared wavelengths of light within the tube that impinge upon the surface of the photo sensitive element located at the other end of the tube. The photo sensitive element changes its electrical conductance as a result of experiencing the particular infrared light.

BRIEF DESCRIPTION OF THE DRAWINGS

The invention will be apparent from the following description with the accompanying drawings, in which.

DESCRIPTION OF THE PREFERRED EMBODIMENT

Figure 1:
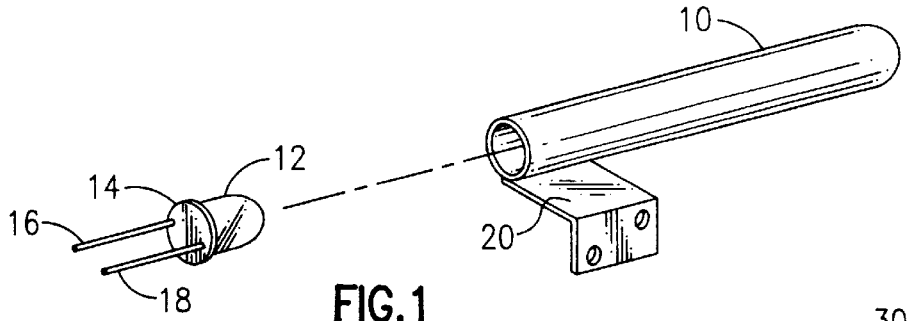
FIG. 1 is an exploded view of an optical flame sensor comprising a closed end hollow tube which receives an infrared photo sensitive element.

Referring to FIG. 1, a hollow opaque closed end tube 10 is illustrated relative to an encapsulated infrared photo sensitive element 12. The closed end tube 10 is preferably fabricated as a single piece part from a non-oxidizing material such as a stainless steel alloy. Such a material is substantially thermally non-conductive so as to essentially conduct little or no heat along the length of the tube. The hollow closed end tube 10 may also be manufactured out of a thermally conductive ceramic material that also produces little heat transfer along the length of the hollow tube. The closed end tube 10 may alternatively be fabricated as two separate parts with the closed end portion being formed as a separate part that is attached to one end of a hollow tube.

The infrared photo sensitive element 12 may be a photo diode, a photo transistor, or other photosensitive electrical device. The encapsulated infrared photosensitive element is preferably mounted to a back end plate 14. If the photosensitive clement is a photo diode, it will have two electrical conductors 16 and 18 extending outwardly from the black end plate 14. The back end plate 14 is preferably circular with a diameter greater than the interior diameter of the hollow closed end tube 10. The infrared photo sensitive element is itself preferably of a diameter slightly less than the interior diameter of the hollow closed end tube 10 so as to extend completely into the hollow closed end tube. The closed end tube 10 is preferably connected to a mounting bracket 20, which allows the closed end tube to be mounted in the furnace adjacent to the burner of the furnace.

Figure 2:
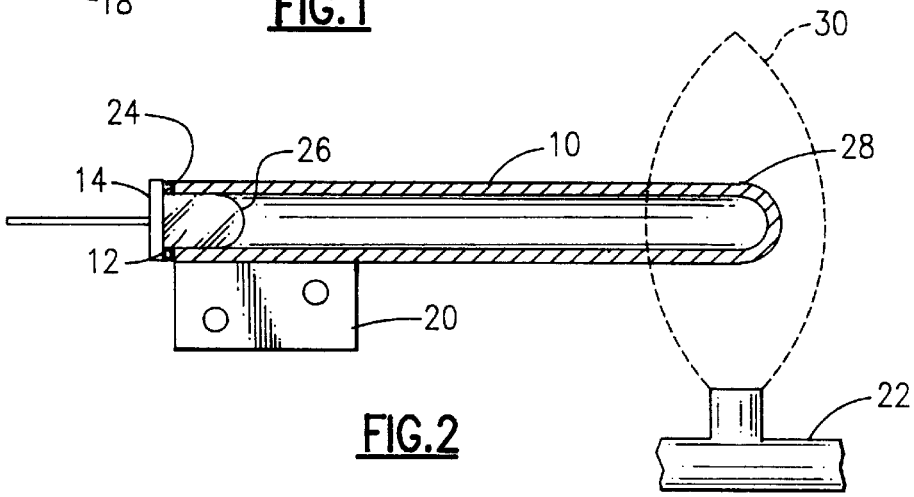
FIG. 2 is a cross-sectional view of the optical flame sensor shown relative to a portion of a furnace burner producing a flame to be sensed by the photo sensor.

Referring to FIG. 2, the thus mounted hollow closed end tube 10 is illustrated relative to a portion of a burner 22 of a furnace. The back end plate 14 is preferably sealed against the open end of the hollow closed end tube 10 by a non-conductive epoxy or adhesive 24 which completely seals this end of the tube from any light. The light sensitive surface 26 of the encapsulated infrared photo sensitive element is preferably oriented toward the closed end 28 of the tube.

The burner portion 22 is seen to produce a flame 30 shown in dotted outline form, which completely encompasses the closed end 28 of the hollow end tube. The tube 10 is mounted within the furnace so as to position the closed end 28 in what is commonly referred to as the "red hot portion" of the flame 30.

The closed end 28 will produce infrared wavelengths of light when heated by the flame 30. These wavelengths of light will impinge upon the light sensitive surface of the infrared photo sensitive element 12. This will cause the photo sensitive element 12 to preferably change its electrical conductance in a particular manner depending on what type of photosensitive element it is.

Figure 3:
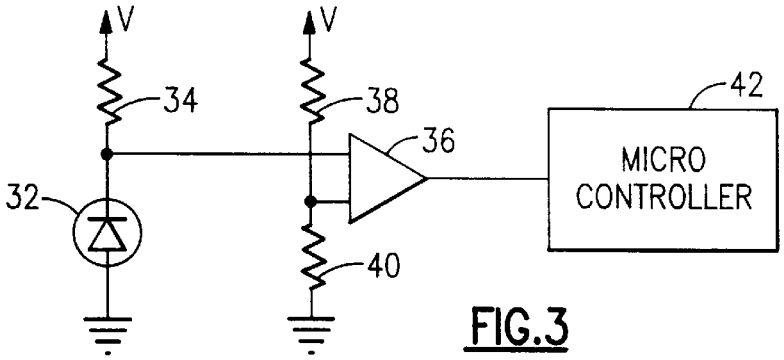
FIG. 3 is an electrical circuit for sensing the presence of a flame when the infrared photo sensitive element is a photo diode.

Referring to FIG. 3, a flame sensing circuit is illustrated wherein the photo sensitive element is a photo diode 32. The photo diode 32 becomes decreasingly resistive to the flow of current from a voltage source, "V", through a reference resistor 34 when exposed to infrared light from the heated closed end 28. The photo diode 32 hence defines an input voltage to a comparator amplifier 36 that falls when its light sensitive surface is exposed to light. The thus decreasing voltage is compared to a threshold voltage for the comparator amplifier 36 defined by a pair of reference resistors 38 and 40 relative to the voltage source, V. The output from the comparator amplifier 36 may be provided to the input of a microcontroller 42, which responds to the change in voltage output from the comparator 36 so as to note the presence of a flame.

Figure 4:
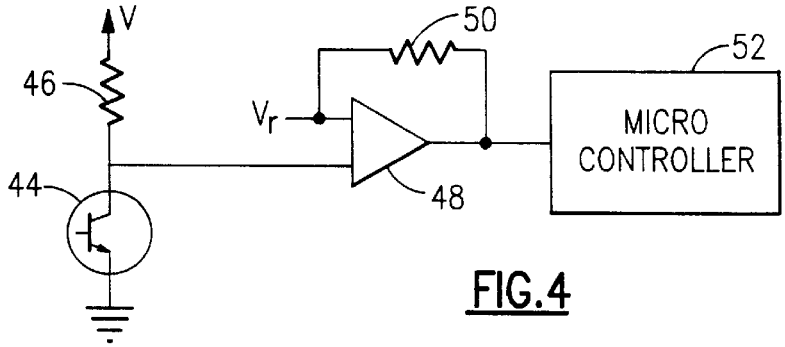
FIG. 4 is an example of an electrical circuit for sensing the presence of a flame when the infrared photo sensitive element is a photo transistor.

Referring to FIG. 4, an electrical sensing circuit is illustrated wherein the infrared photo sensitive element is a photo transistor 44. The particularly depicted photo transistor 44 becomes increasingly conductive when exposed to infrared light produced by a heated closed end 28. The photo transistor 44 is seen to define a path to ground from a voltage supply source, V, through a reference resistor 46. The voltage downstream of the reference resistor 46 in this particular circuit will fall with increasing conductivity of the photo transistor 44. This voltage is applied to an operational amplifier 48 having a feedback resistance 50 that defines a reference voltage, $V_r$ to the operational amplifier. The output of the operational amplifier is preferably connected to the input of a microcontroller 52. The microcontroller is programmed to recognize the operational amplifier output produced by the conductive photo transistor as indicating the presence of a flame at the closed end 28.

It is to be appreciated that a particular embodiment of the invention has been described. Alterations, modification and improvements thereto will readily occur to those skilled in the art. Accordingly, the foregoing description is by way of example only and the invention is to be limited by the following claims and equivalents thereto.

What is claimed is:

1. A flame sensor for sensing the flame produced by a burner within a furnace, said sensor comprising:

a hollow tube having at least one closed end said closed end being formed of an opaque non-translucent material so as to prevent any external light from entering through the closed end; and an infrared photo sensitive element, positioned within the tube at a distance from the closed end of the tube so as to avoid any significant heat transfer from said closed end of the tube, said infrared photo sensitive element having an active, photo sensitive surface oriented toward the closed end of the tube whereby infrared light produced by the closed end impinges on the photo sensitive surface when the closed end is subjected to heat from the flame.

2. The flame sensor of claim 1 wherein said hollow tube is fabricated from a corrosion resistant alloy steel material having a substantially low thermal conductivity.

3. The flame sensor of claim 1 further comprising:

a back end plate secured to the opposing end of the hollow tube so as to seal off the interior of the tube from any external light.

4. The flame sensor of claim 3 further comprising:

circuitry connected to the photo sensitive element, said circuitry being operative to detect a change in conductivity of the photo sensitive element when the closed end is heated by a burner flame.

5. The flame sensor of claim 4 wherein the photo sensitive element is a photo diode.

6. The flame sensor of claim 4 wherein the photo sensitive element is a photo transistor.

7. The flame sensor of claim 1 further comprising:

a back end plate secured to the opposing end of the hollow tube so as to seal off the interior of the tube from any external light.

8. The flame sensor of claim 7 wherein the photo sensitive element is mounted to the back end plate so as to extend into the interior of the hollow tube, said photo sensitive element having electrical conductors extending through the back end plate.

9. The flame sensor of claim 8 further comprising:

circuitry connected to the electrical conductors extending from said back end plate, said circuitry being operative to detect a change in conductivity of the photo sensitive element when the closed end is heated by a burner flame.

10. The flame sensor of claim 9 wherein the photo sensitive element is a photo diode.

11. The flame sensor of claim 9 wherein the photo sensitive element is a photo transistor.

* * * * *